US006018215A

United States Patent [19]

Takemura

[11] Patent Number: 6,018,215

[45] Date of Patent: Jan. 25, 2000

[54] FIELD EMISSION COLD CATHODE HAVING A CONE-SHAPED EMITTER

[75] Inventor: Hisashi Takemura, Tokyo, Japan

[73] Assignee: NEC Corporation, Tokyo, Japan

[21] Appl. No.: 08/957,778

[22] Filed: Oct. 27, 1997

[30] Foreign Application Priority Data

Nov. 22, 1996 [JP] Japan ..... 8-312163

[51] Int. Cl.[7] ..... H01J 7/44

[52] U.S. Cl. ..... 313/309; 313/495; 313/311

[58] Field of Search ..... 313/308, 359, 313/495, 310, 311

[56] References Cited

U.S. PATENT DOCUMENTS

| | | | |
|---|---|---|---|
| 5,229,331 | 7/1993 | Doan et al. | 437/228 |
| 5,283,500 | 2/1994 | Kochanski | 315/58 |
| 5,315,207 | 5/1994 | Hoeberechts et al. | 313/444 |
| 5,343,110 | 8/1994 | Kaneko et al. | 313/309 |
| 5,401,676 | 3/1995 | Lee | 437/200 |
| 5,543,680 | 8/1996 | Tomihari | 313/336 |
| 5,644,187 | 7/1997 | Jaskie et al. | 313/293 |
| 5,719,477 | 2/1998 | Tomihari | 315/381 |
| 5,734,223 | 3/1998 | Makishima et al. | 313/495 |
| 5,786,657 | 7/1998 | Okamoto | 313/308 |
| 5,814,931 | 9/1998 | Makishima | 313/441 |

FOREIGN PATENT DOCUMENTS

| | | | |
|---|---|---|---|
| 3-1429 | 1/1991 | Japan | H01J 29/50 |
| 4-289642 | 10/1992 | Japan | H01J 31/12 |
| 7-14500 | 1/1995 | Japan | H01J 1/30 |
| 7-201273 | 8/1995 | Japan | H01J 1/30 |
| 7240143 | 9/1995 | Japan | H01J 1/30 |
| 7-296717 | 11/1995 | Japan | H01J 1/30 |

*Primary Examiner*—Vip Patel
*Assistant Examiner*—Matthew J. Gerike
*Attorney, Agent, or Firm*—Hayes, Soloway, Hennessey, Grossman & Hage PC

[57] ABSTRACT

A field emission cold cathode in which all protrusion portions and corner portions around a gate electrode as well as corner portions facing an anode electrode are formed so as to be at obtuse angles or arc-shaped, whereby discharging of the gate electrode is suppressed to prevent breakdown of the device. A dummy electrode having more acute protrusion portions of the gate electrode is provided around the gate electrode, to further suppress discharging of the gate electrode.

10 Claims, 10 Drawing Sheets

FIELD EMISSION COLD CATHODE HAVING A CONE-SHAPED EMITTER

BACKGROUND OF THE INVENTION

1. Field of the Invention

The present invention relates to a field emission cold cathode and a display apparatus using a field emission cold cathode, more particularly to a gate electrode of the field emission cold cathode.

2. Description of the Related Art

A field emission cold cathode is a device which comprises an emitter having a sharp cone-shaped emitter and a gate electrode having an opening of sub-million order, formed close to the emitter, and functions in such manner that it concentrates a high level electric field at a tip of the emitter by the gate electrode, emits electrons from the tip of the emitter under vacuum, and receives the electrons in its anode electrode. In such a field emission cold cathode, discharge of the gate electrode sometimes occurs during operation under vacuum, due to collision of the electrons to the anode electrode and residual gas. The discharge of the gate electrode causes damage such as breaking due to the fusion of materials forming the gate electrode and shorts due to the breakdown of an insulating film under the gate electrode.

In order to prevent such damage due to discharge, various methods have been proposed. By way of example reference is made to a conventional field emission cold cathode disclosed in Japanese Patent Application Laid Open No. 7-240143/1995 is shown in a sectional view of FIG. 1 and a plan view of FIG. 2.

As shown in FIG. 1, a conventional electric field emission cold cathode consists of a silicon substrate 1 serving as a supporting substrate; an insulating film 2 such as an oxide film, formed on the silicon substrate 1; a gate electrode 3*a* formed on the insulating film 2 and having an opening at an emitter formation region; and an emitter 5*a* formed in the opening of the insulating film 2, the emitter being connected to the silicon substrate 1; and an insulating film 8 formed so as to cover the gate electrode 3*a*. An anode electrode 7 is disposed so as to face the gate electrode 3*a* by spatially separating it from the emitter 5*a*. As shown in FIG. 1, the gate electrode 3*a* is of the conventional field emission cold cathode type and has a shape in section such that the side surface of the opening of the gate electrode 3*a* is approximately perpendicular to the surface of the silicon substrate 1 and the upper surface of the insulating film 8. Moreover, as shown in FIG. 2, when viewed from above, the gate electrode 3*a* has a configuration which generally includes a rectangular portion having four right angle corners. In such conventional field emission cold cathode, the insulating film surrounds the gate electrode, whereby the occurrence of discharge of the gate electrode due to residual gas near the gate electrode is prevented and the breakdown of the device resulting from a discharge between the emitter and the gate electrode is suppressed.

However, in the foregoing conventional field emission cold cathode, there has been a first problem that a gate voltage required to cause the emitter to emit electrons cannot be reduced. Specifically, since a conventional field emission cold cathode employs a structure in which the gate electrode is surrounded by the insulating film, a margin for depositing the insulating film between the emitter and the gate electrode is necessary, so that operation at low voltage is limited by the amount equivalent to the margin. In order to overcome such problem, an additional mechanism to enhance an electric field must be incorporated into a conventional prior art device, so that complexities of device structure and processes for manufacturing the device result, which entail disadvantages in manufacturing a conventional device.

Furthermore, in a conventional field emission cold cathode, there is a second problem in that breakdown due to discharging from the anode electrode occurs. Specifically, the gate electrode is protected by the insulating film, whereby breakdown due to discharge between the emitter and the gate electrode during operation at low voltage can be prevented effectively. However, the insulating film covering the gate electrode has less effect to prevent the breakdown due to discharge from the anode electrode so that the breakdown of the insulating film under the gate electrode is apt to occur with a high probability.

SUMMARY OF THE INVENTION

In order to solve the foregoing problems, the object of the present invention is to suppress breakdown of a gate electrode at the time of discharge from an anode electrode. Particularly, the object of the present invention is to provide a simple field emission cold cathode which is capable of preventing breakdown due to discharge from the anode electrode which causes a large scale breakdown.

In order to achieve the foregoing objects, a field emission cold cathode of the present invention comprises an emitter 5*a* having a sharp tip portion, a gate electrode 3*a* having an opening surrounding the emitter 5*a*, and an anode electrode 7 serving as an electron collector, formed above, the improvement wherein each of sides of the gate electrode intersect an adjacent side at an obtuse angle.

A field emission cold cathode of the present invention comprises an emitter 5*a* having a sharp tip portion, a gate electrode 3*a* having an opening surrounding the emitter 5*a*, and an anode electrode 7 serving as an electron collector, formed above, the improvement wherein each of sides of the gate electrode intersect an adjacent side in an arc-shape.

A field emission cold cathode of the present invention comprises an emitter 5*a* having a sharp tip portion, a gate electrode 3*a* having an opening surrounding the emitter 5*a*, and an anode electrode 7 serving as an electron collector, formed above, the improvement wherein the upper surface of the gate electrode facing the anode electrode intersects a side surface thereof at an obtuse angle and a lower surface of the gate electrode on the insulating film intersects the side surface thereof at an obtuse angle.

A field emission cold cathode of the present invention comprises an emitter 5*a* having a sharp tip portion, a gate electrode 3*a* having an opening surrounding the emitter 5*a*, and an anode electrode 7 serving as an electron collector, formed above, the improvement wherein an upper surface of the gate electrode facing the anode electrode and a side surface thereof intersect in the form of an arc-shape and a lower surface of the gate electrode on the insulating film and the side surface thereof intersect in the form of an arc-shape.

A field emission cold cathode of the present invention comprises a gate electrode having an upper surface facing an anode electrode and a lower surface on an insulating film, each surface having projection portions in its periphery composed of at least more than one side, each side intersecting an adjacent side at an obtuse angle.

A field emission cold cathode of the present invention comprises a gate electrode having an upper surface facing an anode electrode and a lower surface on an insulating film, each surface having projection portions in its periphery composed of at least more than one side, each side intersecting an adjacent side forming approximately an arc-shape.

A field emission cold cathode of the present invention comprises a gate electrode having an upper surface facing an anode electrode and a lower surface on an insulating film, corner portions of each surface being approximately arc-shaped.

A field emission cold cathode of the present invention comprises a dummy gate provided arranged around gate electrode, the dummy gate having at lest one projection portion composed of sides, each of which intersects an adjacent side forming a smaller angle than that of the gate electrode.

A field emission cold cathode of the present invention comprises a dummy emitter electron formed in a sharp shape in at least one portion of the dummy electrode, the dummy emitter electrode protruding from a gate electrode.

Further, a display apparatus of the present invention uses a field emission cold cathode of the present invention as an electron gun.

FIGS. 3(*a*) and 3(*b*) are sectional views showing a basic embodiment of a field emission cold cathode of the present invention. FIG. 4 is a plan view thereof, and FIG. 5(*d*) is a sectional view of a block shown by A and B of FIG. 4.

Referring to FIG. 3(*a*), the field emission cold cathode consists of an emitter 5*a* having a sharp tip; a gate electrode 3*a* and an insulating film 2 formed so as to surround the emitter 5*a*; and an anode electrode 7 formed above the gate electrode 3*a* and the emitter 5*a*. The gate electrode 3*a* has an arc-shaped section at an emitter side end portion of its surface facing the anode electrode.

During an operation of the field emission cold cathode, a high voltage of 100V or more is applied between the anode electrode 7 and the gate electrode 3*a*, and a voltage of about 100V is applied between the gate electrode 3*a* and the emitter 5*a*. Generally, it has been known the discharge phenomenon is apt to occur between sharp tip ends of metals. The gate electrode 3*a* of this field emission cold cathode has a shape which causes less discharge compared to a conventional gate electrode in that it has a section in which the horizontal surface and the side surface thereof intersect at a right angle, whereby discharge between the anode electrode 7 and the gate electrode 3*a* is suppressed.

Further, referring to FIG. 3(*b*), the gate electrode has a section, in which all corners of the gate electrode 3*a* are arc-shaped. With gate electrode 3*a* having such a shape, since all corners of the gate electrode 3*a* facing the emitter 5*a* and the silicon substrate 1 serving as the emitter electrode are arc-shaped, there is a discharge suppression effect on the emitter 5*a* as well as on the anode electrode 7.

Moreover, an application example in which all corners of the gate electrode 3*a* on a horizontal projection lane are at an obtuse angle is shown in FIG. 6. With gate electrode 3*a* having such a shape, electric field concentration is less apt to occur compared to the case where all corners thereof are a right angle, whereby a breakdown due discharge of the gate electrode can be further suppressed. Particularly, discharge between the anode electrode 7 and the gate electrode 3*a* which are arranged facing each other and applied with a high voltage can be effectively suppressed.

Moreover, as shown in FIG. 8, in addition to the gate electrode 3*a* formed on a chip and the emitter 5*a* formed in the opening of the gate electrode 3*a* around the gate electrode 3*a*, it is possible to provide a dummy electrode 3*b* having a protrusion portion at each of its corners, a side of the protrusion portion intersecting an adjacent side making an acute angle. With a dummy gate of such shape, the discharge of the gate electrode is guided to the protrusion portion of the dummy electrode so that the discharge of the gate electrode is suppressed.

As described above, the field emission cold cathode of the present invention comprises a gate electrode in which no protrusion portion of an acute angle is formed in sections in horizontal and vertical directions, whereby electric field concentration can be avoided by addition of simple steps and discharge can be suppressed, resulting in a reduction in breakdowns of the device due to the discharge of the gate electrode.

Moreover, around the gate electrode, a dummy gate is provided which has at least one protrusion portion at an interior angle smaller than that of the corners of the protrusion portion of the gate electrode, and discharge of the gate electrode is guided to the dummy gate, whereby damage due to discharge of the gate electrode can be suppressed.

Moreover, the field emission cold cathode of the present invention capable of suppressing damage due to discharge of the gate electrode is used as an electron gun of a display apparatus, for example, as a flat panel display or a cathode tube for a display, which can prolong the life time of the display apparatus.

The above and other objects, features and advantages of the present invention will become apparent from the following description referring to the accompanying drawings which illustrate an example of a preferred embodiment of the present invention.

DETAILED DESCRIPTION OF THE PREFERRED EMBODIMENTS

Next, embodiments of the present invention will be described with reference to the accompanying drawings.

Figure 1:
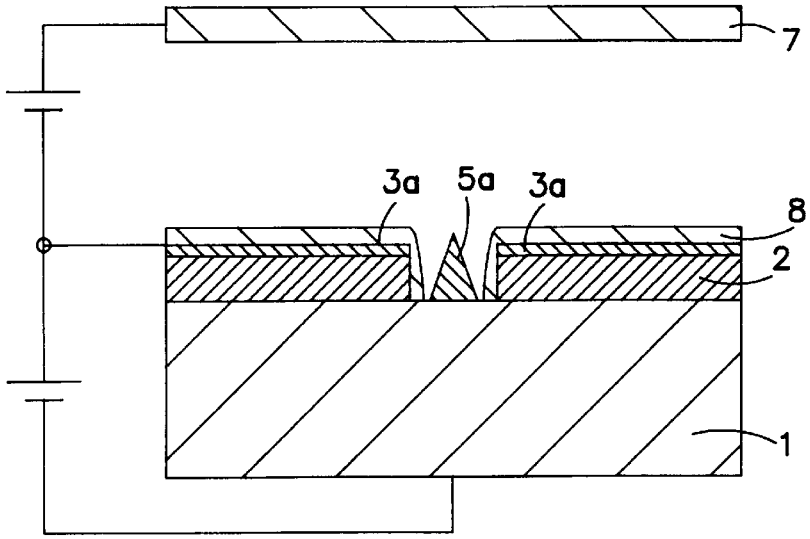
FIG. 1 PRIOR ART
FIG. 1 is a sectional view of an example of a conventional field emission cold cathode.
Figure 2:
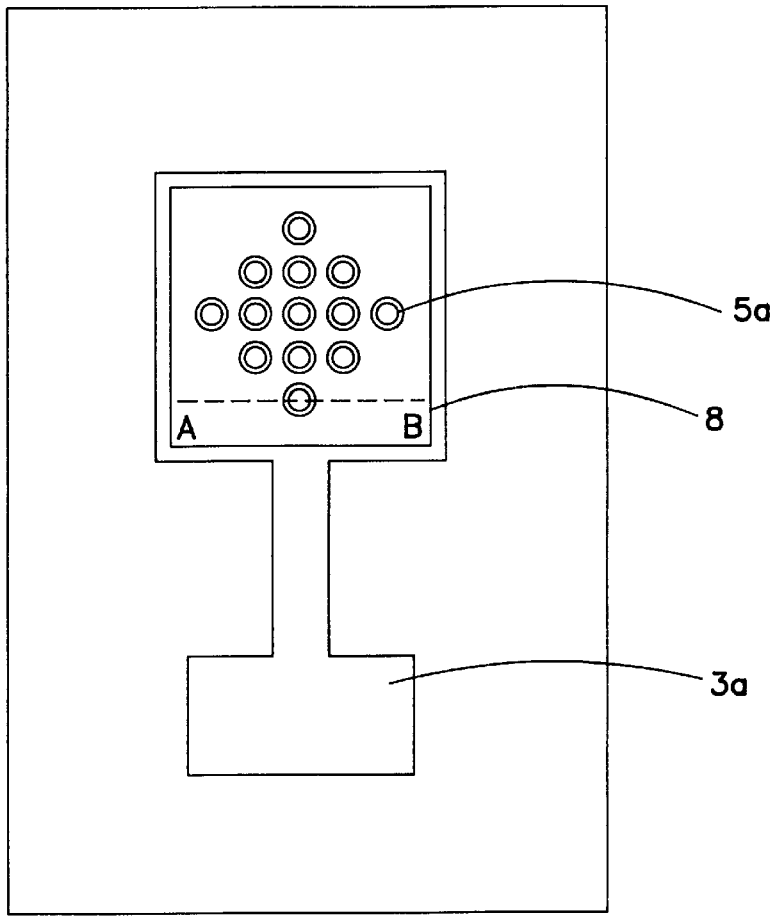
FIG. 2 PRIOR ART
FIG. 2 is a plan view of an example of a conventional field emission cold cathode.
Figure 3A:
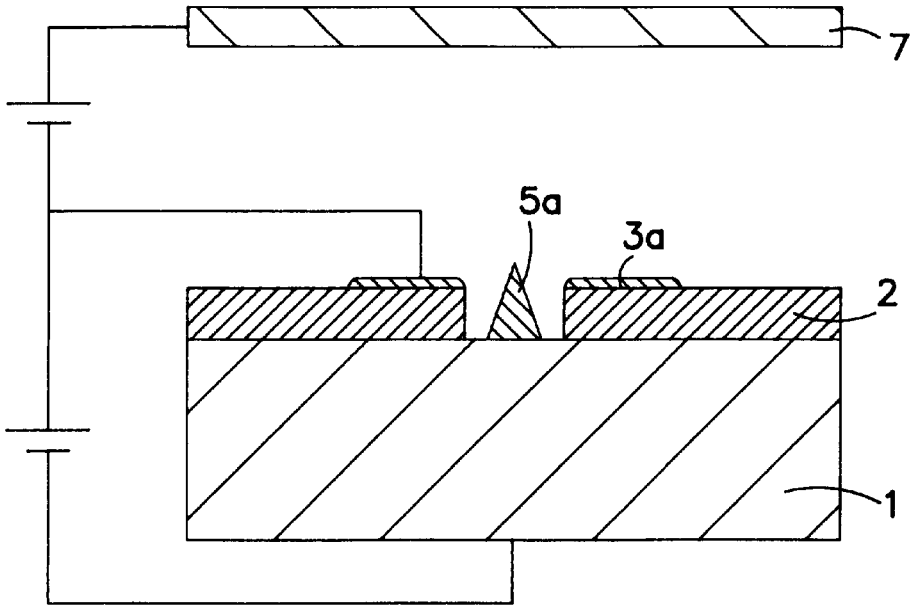
FIG. 3(*a*) and FIG. 3(*b*) are sectional views of a first embodiment of a field emission cold cathode of the present invention.
Figure 3B:
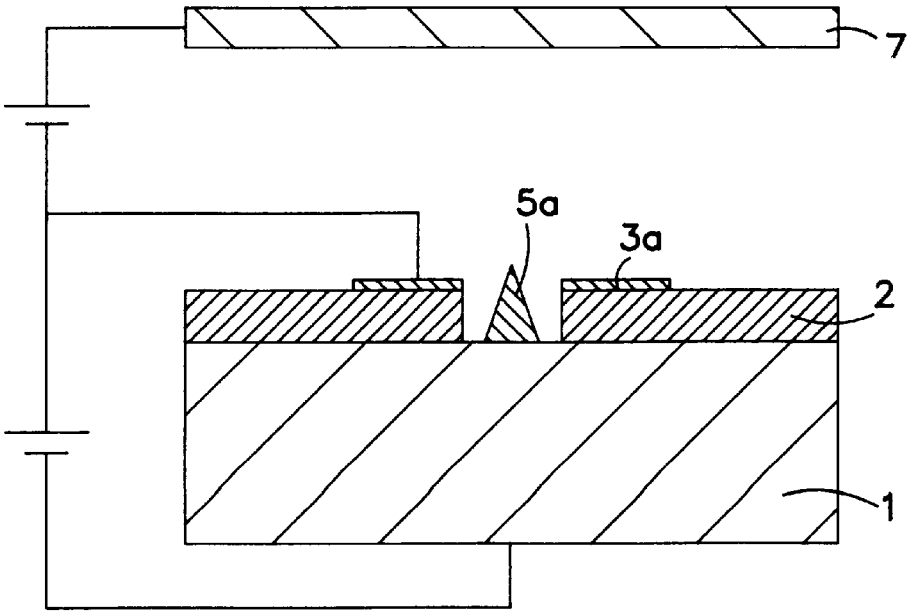
Figure 4:
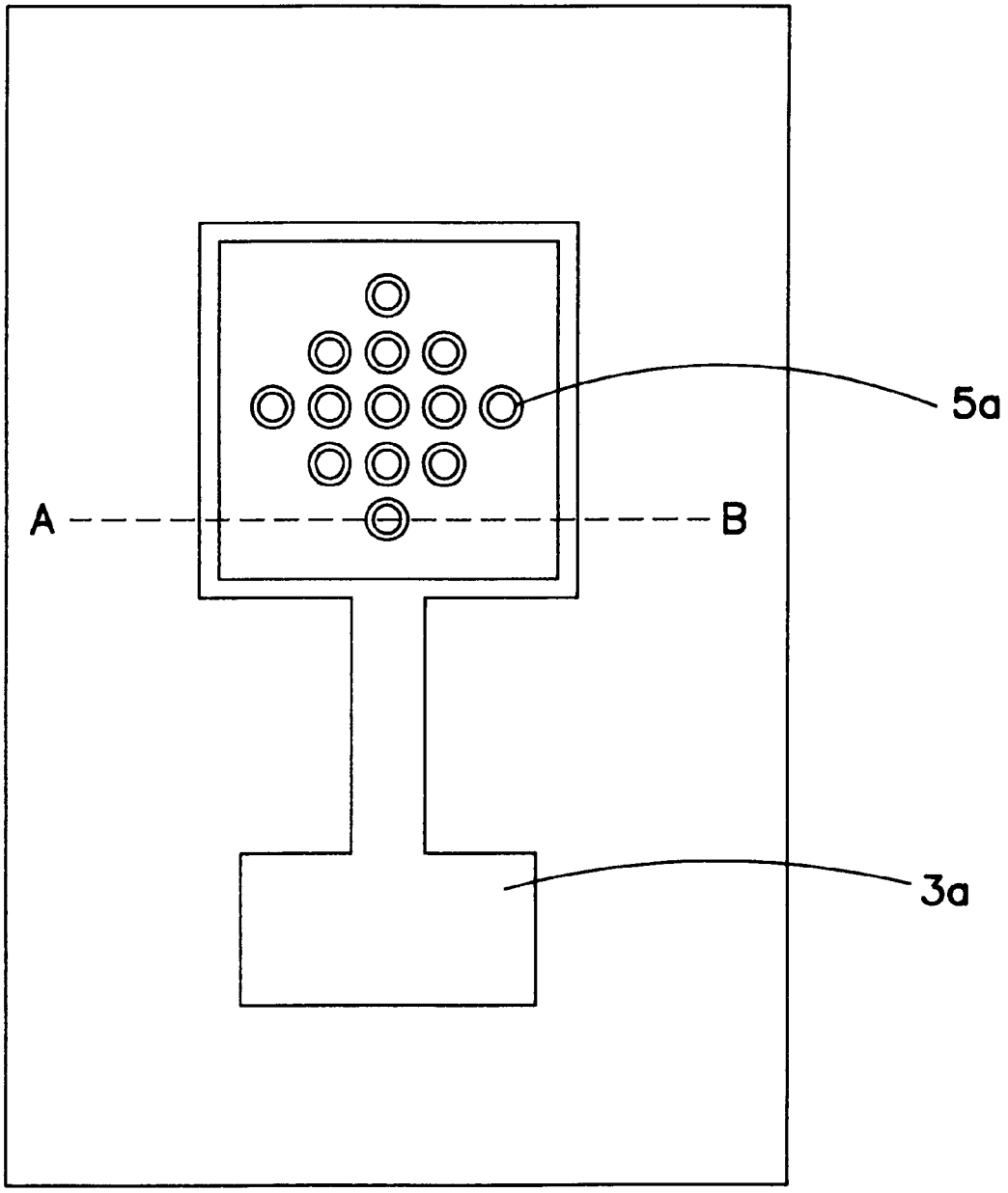
FIG. 4 is a plan view of the first embodiment of the field emission cold cathode of the present invention.
Figure 5A:
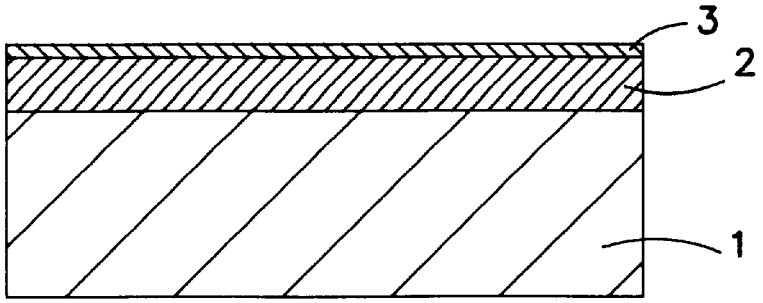
FIG. 5(*a*) to FIG. 5(*d*) are sectional views showing manufacturing steps of the first embodiment of the field emission cold cathode of the present invention.
Figure 5B:
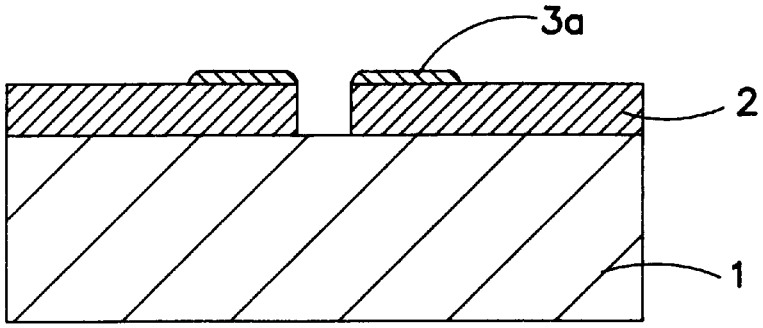
Figure 5C:
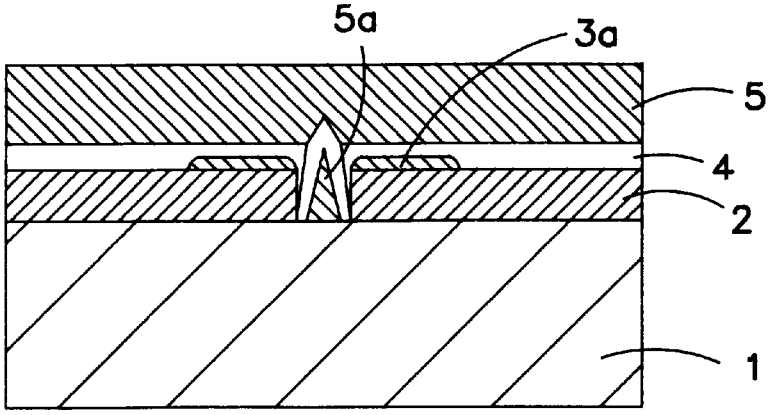
Figure 5D:
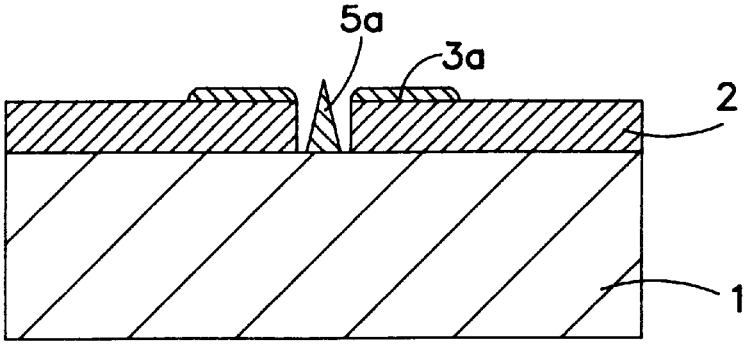

FIG. 5(*a*) to FIG. 5(*d*) are sectional views showing manufacturing steps of a first embodiment of a field emission cold cathode of the present invention shown in FIG. 3(*a*).

As shown in FIG. 5(*a*), first, an insulating film 2 of about 500 nm thick is formed on an n-type silicon substrate 1 of about $10^{15}/cm^3$. Thereafter, an electrode film 3 formed of a metal film such as W is deposited to a thickness of about 200 nm using a method such as sputtering.

Next, as shown in FIG. 5(*b*), the electrode film 3 is selectively etched using a mask such as a resist so that a gate electrode 3*a* is formed. Further, the gate electrode 3*a* and the insulating film 2 are etched by an RIE (reactive ion etching) method in a photolithography step, thereby forming an opening to expose the silicon substrate 1.

At the time of etching to form the gate electrode 3*a*, an isotropy etching is performed and subsequently an anisotropy etching is performed, whereby the gate electrode 3*a* comes to have a shape without ridge lines at curved corners in its upper portion.

Next, as shown in FIG. 5(*c*), by an electron beam deposition method, a sacrifice layer 4 formed of A1 of about 100 nm is deposited from an oblique direction declined by a predetermined angle with respect to a vertical direction. In this step, since the sacrifice layer 4 is deposited in the oblique direction from above, the sacrifice layer 4 is not formed on the exposed silicon substrate 1 which is to be an emitter formation region and the sacrifice layer 4 is formed on the side wall of the insulating film 2 and on the gate electrode 3*a*. Next, an emitter material layer 5 such as Mo is deposited from the vertical direction by an electron beam deposition method. In this step, the emitter material layer 5 is grown on the sacrifice layer 4 and the silicon substrate 1, the shape of the emitter material layer on the silicon substrate 1 becomes cone-shaped, so that an emitter 5*a* is formed.

Next, as shown in FIG. 5(*d*), the sacrifice layer 4 is removed by etching in a solution such as phosphoric acid, whereby the emitter material layer 5 on the sacrifice layer 4 is removed so that the emitter 5*a* is exposed.

By the above-described steps, the field emission cold cathode shown in FIG. 3(*a*) is obtained.

By this method, the gate electrode 3*a* having a shape in which the ridge lines in its upper surface are rounded so as to promote little discharging can be easily obtained.

As shown in FIG. 3(*b*), in order to manufacture a device in which the ridge line portions on the upper and lower surface of the gate electrode 3*a* is obtuse angular or arc-shaped, when utilizing dry etching using SF6 or the like for the electrode film 3 having a multilayer structure composed of a polycrystalline silicon film as a lower layer and a WSi film as an upper layer, the device can be manufactured utilizing their etching rate difference. As other methods, the device can be manufactured also by varying the impurity concentration in the electrode film to vary the etching rate. For example, when a polycrystalline silicon film having a p-type high concentration layer at its center portion is used as the electrode film and an alkali solution such as anisotropy KOH, the etching rate for a high concentration p-type region becomes low, and selective etching will be possible, whereby a desired shape can be obtained. Moreover, also in an electrode film in which n-type impurity atoms are added to its upper and lower surfaces with a high concentration, a high concentration region whereby the etching rate is high is etched more so that a desired shape can be obtained.

Next, a second embodiment of the present invention will be described.

Figure 6A:
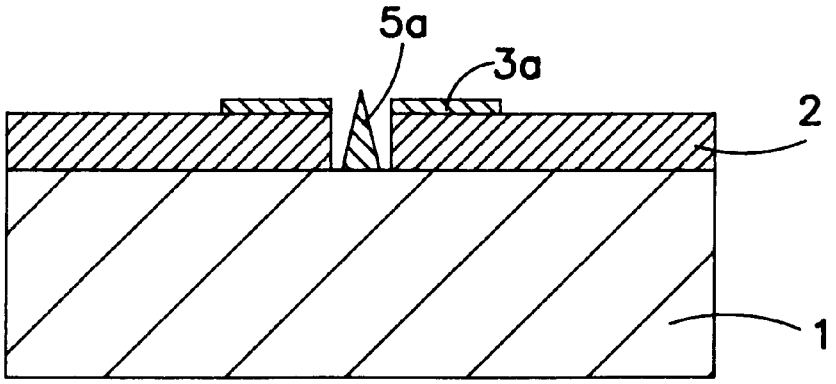
FIG. 6(*a*) and FIG. 6(*b*) are a sectional view and a plan view of a second embodiment of a field emission cold cathode of the present invention, respectively.
Figure 6B:
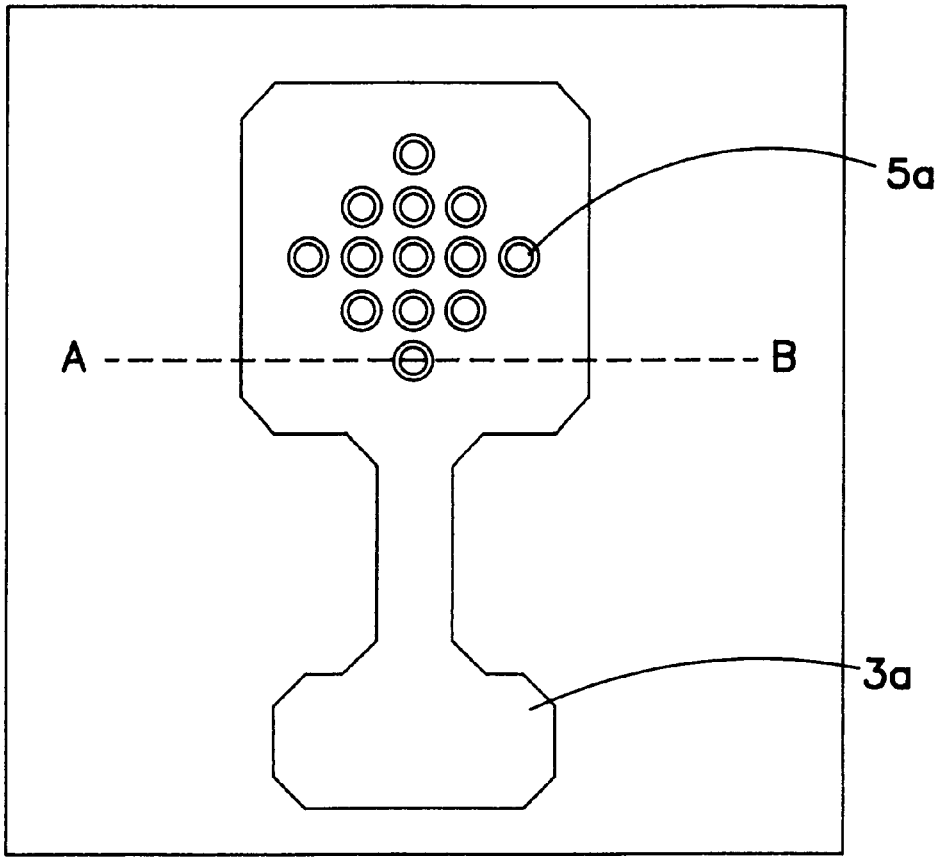
Figure 7A:
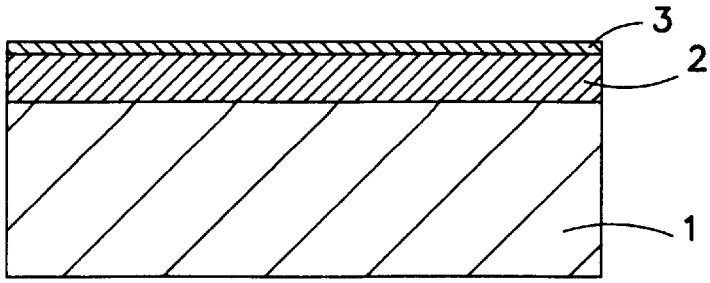
FIG. 7(*a*) and 7(*d*) are sectional views showing manufacturing steps of a third embodiment of a field emission cold cathode of the present invention.
Figure 7B:
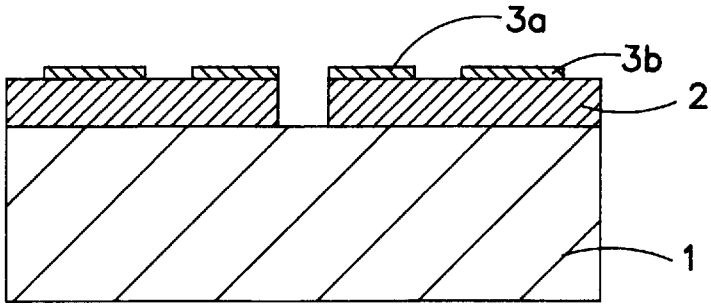
Figure 7C:
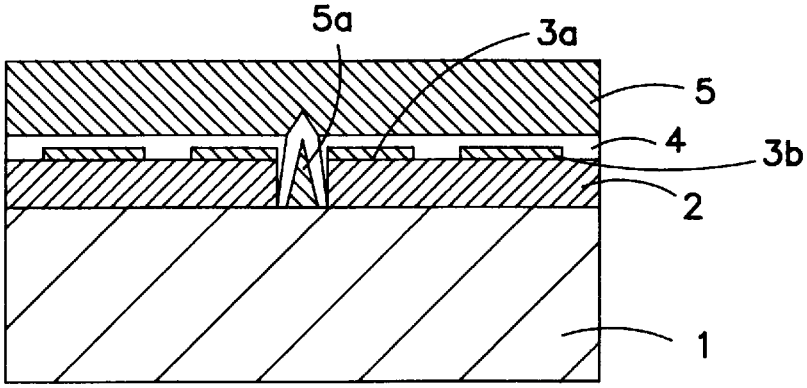
Figure 7D:
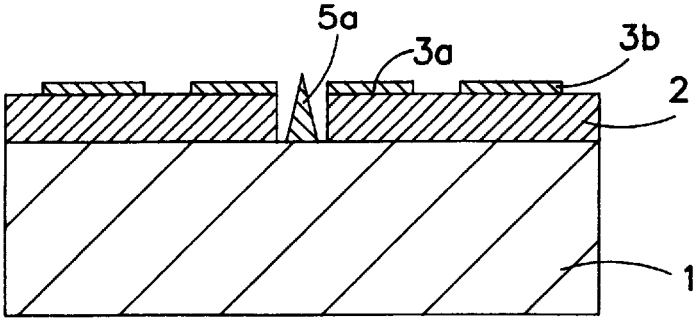

FIG. 6(*a*) is a sectional view of the second embodiment. The configuration is shown in section, and this configuration can be obtained by changing the shape of the gate electrode 3*a* in FIG. 5(*d*) such that the ridge line portions make a right angle. FIG. 6(*b*) is a plan view of the second embodiment. In FIG. 6(*b*), the corner portions of the gate electrode 3*a* are designed such that they make an obtuse angle when viewed from the above. In the first embodiment, no corner portions at an acute angle exist. In this embodiment, the corner portions when viewed from the above make an acute angle. Thus, the discharge between the anode electrode and the gate electrode can be suppressed. The corner portions when viewed from the above may have an arc-shape, not an obtuse angle.

Next, a third embodiment of the present invention will be described.

FIG. 7(*a*) to 7(*d*) are sectional views showing manufacturing steps of a field emission cold cathode of the third embodiment.

First, as shown in FIG. 7(*a*), an insulating film 2 of about 500 nm thick such as an oxide film is formed on an n-type silicon substrate 1 having a concentration of about $10^{15}/cm^3$. Thereafter, an electrode film 3 formed of a metal film such as W is deposited to about 200 nm thick by a method such as sputtering.

Next, as shown in FIG. 7(*b*), the electrode film 2 is selectively etched using a mask such as a resist so that a gate electrode 3*a* and a dummy electrode 3*b* are formed. Moreover, the gate electrode 3*a* and the insulating film 2 are etched using an RIE method in a photolithography step, thereby forming an opening to expose the silicon substrate 1.

Next, as shown in FIG. 7(*c*), using an electron beam deposition method, a sacrifice layer 4 formed of A1 is deposited to a thickness of about 100 nm from an oblique direction declined from the vertical direction. In this step, since the sacrifice layer is deposited obliquely from above, the sacrifice layer 4 is not formed on the exposed silicon substrate 1 which is to be an emitter formation region and the sacrifice layer 4 is formed on the side wall of the insulating film 2, the gate electrode 3*a* and the dummy electrode 3*b*. Next, for example, an emitter material layer 5 such as Mo is deposited from the vertical direction using an electron beam deposition method. In this step, the emitter material layer 5 is grown on the sacrifice layer 4 and the silicon substrate 1, and the shape of the portion of the emitter material layer located on the silicon substrate 1 made cone-shaped, whereby the emitter 5*a* is formed.

Figure 8:
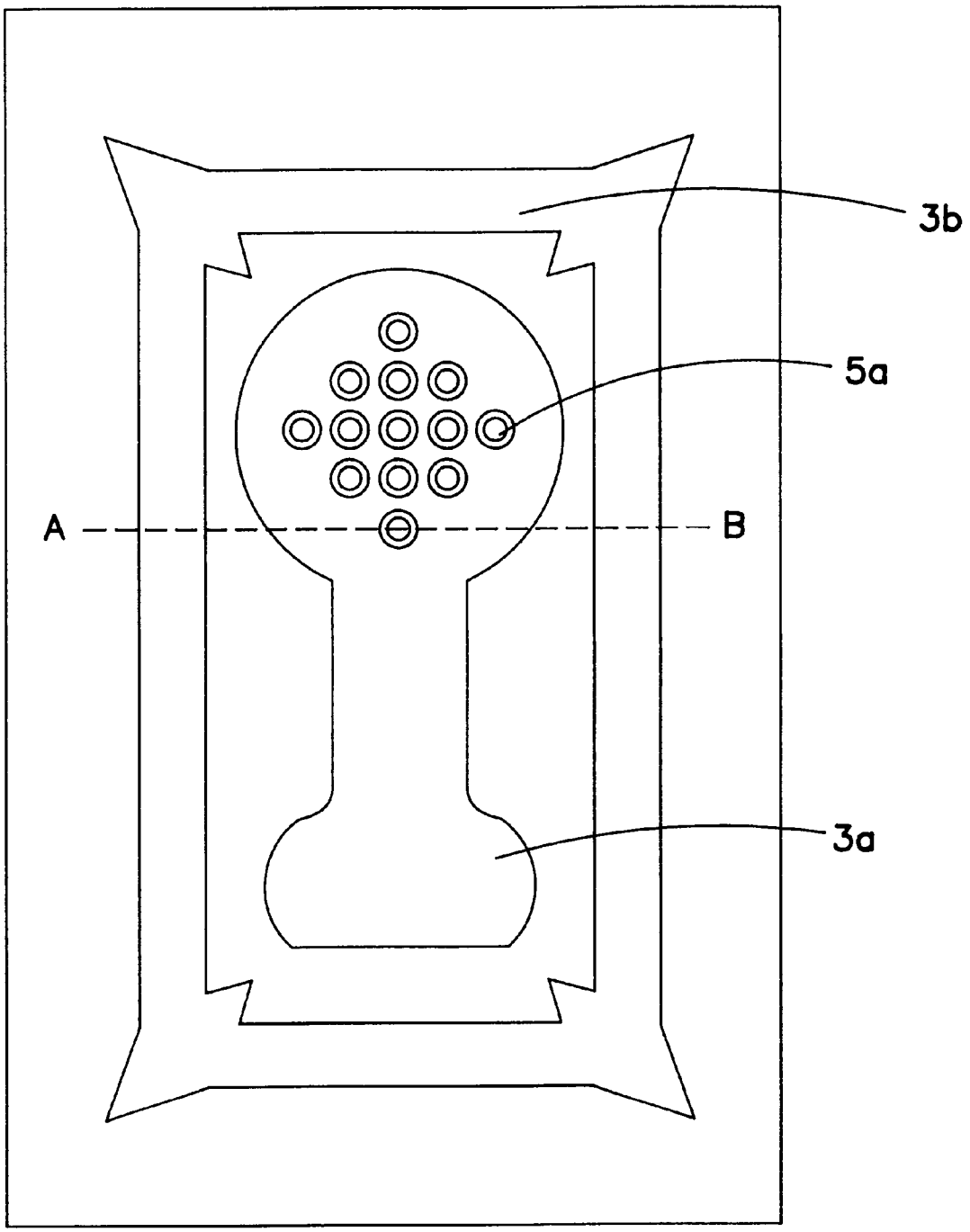
FIG. 8 is a plan view of the third embodiment of the field emission cold cathode of the present invention.

Next, as shown in FIG. 5(*d*), the sacrifice layer 4 is removed by etching in, for example, phosphoric acid solution. Thus, the emitter material layer 5 on the sacrifice layer 5 is removed so that the emitter 5*a* is exposed. A plan view of the third embodiment is shown in FIG. 8. A sectional view taken along the line A–B of the FIG. 8 is shown in FIG. 7(*d*).

In this embodiment, a dummy electrode 3*b* which is not electrically connected to the gate electrode is formed around the gate electrode 3*a*. By forming a protrusion portion at an acute angle in the dummy electrode 3*b*, the dummy electrode 3*b* is more apt to discharge electrons than the gate electrode 3*a*, so that the gate electrode 3*a* is protected. In this embodiment, the corner portions of the gate electrode 3*a* are arc-shaped. However, when the corner portions of the gate electrode 3*a* are protrusions with an angle, the same effects are exhibited similar to the case where the corner portions of the gate electrode 3*a* are arc-shaped, as long as the corner portions of the gate electrode 3*a* have larger angles than those of the protrusion portions of the dummy gate 3*b*. Moreover, the dummy electrode 3*b* is provided with protrusion portions with acute angles in both its inner and outer peripheries. The shape of the dummy gate 3*b* is not limited to this, the protrusion portions with acute angles may be provided in the outer periphery, as a matter of course. For example, when the corner portions of the dummy electrode 3*b* close to the gate electrode 3*a* are formed at obtuse angles, there is an advantage in that the gate electrode 3*a* is less influenced by breakdown at the time of discharging. Moreover, although the dummy electrode 3*b* is designed such that the dummy electrode 3*b* completely surrounds the gate electrode 3*a*, the shape of the dummy gate 3*b* is not limited to this. The dummy electrode 3*b* may be formed so as to partially surround the gate electrode 3*a*. Moreover, when this embodiment is used in combination with the first embodiment in which the corner portions when viewed in section are at obtuse angles, the discharge suppression effect against the gate electrode is further increased.

Figure 9A:
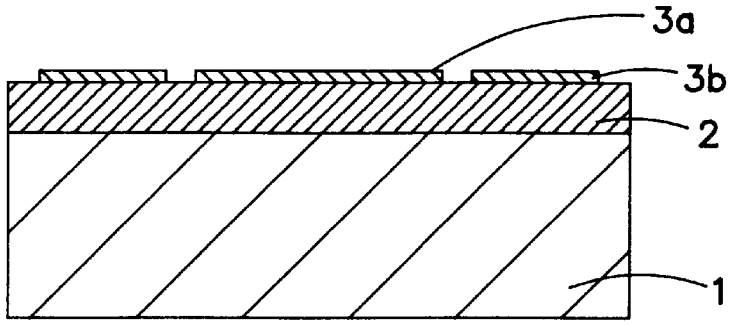
FIG. 9(*a*) to FIG. 9(*c*) are sectional views showing manufacturing steps of a fourth embodiment of a field emission cold cathode of the present invention.
Figure 9B:
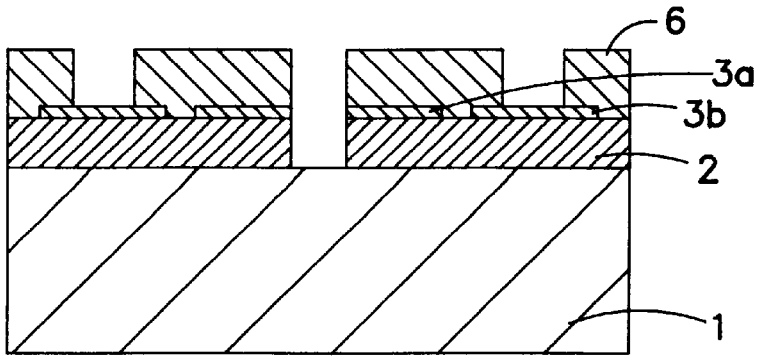
Figure 9C:
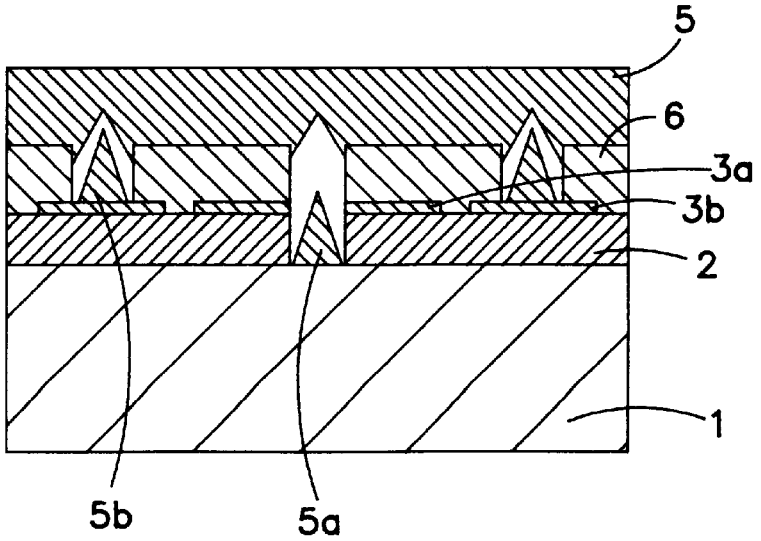

Next, a fourth embodiment of the present invention will be described with reference to FIGS. 9(*a*) to 9(*c*) and FIG. 10.

First, an insulating film 2 of about 500 nm thick such as an oxide film is formed on a surface of an n-type silicon substrate 1 of a concentration of about $10^{15}/cm^3$ by thermal oxidation. Thereafter, an electrode film 3 formed of a metal film such as W is deposited to a thickness of about 200 nm by a sputtering method or the like. The electrode film 3 is etched using a mask such as a resist, so that a gate electrode 3*a* is formed, as shown in FIG. 9(*a*).

Next, a sacrifice layer 6 formed of A1 is deposited to a thickness of about 500 nm by a sputtering method, an electron beam deposition method or the like, and a resist is formed. An opening is formed on a dummy electrode 3*b* by a photolithography method, and the sacrifice layer 6 is selectively etched so that the dummy electrode 3*b* is exposed. Moreover, an opening is formed by etching the sacrifice layer 6, the gate electrode 3*a* and the insulating film 2 by a photolithography method, which correspond to an emitter formation region, as shown in FIG. 9(*b*).

Next, an emitter material layer 5 formed of Mo or the like is deposited from a vertical direction by an electron beam deposition method. In this step, the emitter material layer 5 is deposited on the sacrifice layer 6, the exposed dummy electrode 3*b* and the exposed silicon substrate 1. The portions of the emitter material layer 5 on the dummy electrode 3*b* and the silicon substrate 1 are formed in a cone shape, as are those portions of the emitter materials 5 are a dummy emitter 5*b* and an emitter 5*a*, as shown in FIG. 9(*c*).

Figure 10:
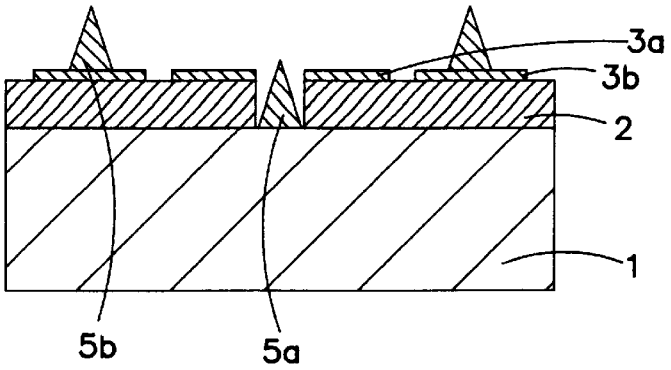
FIG. 10 is a sectional view of the fourth embodiment of the field emission cold cathode of the present invention.

Next, as shown in FIG. 10, the sacrifice layer 6 is removed by etching in a solution such as phosphoric acid. Thus, the emitter material layer 5 on the sacrifice layer 6 is removed so that the emitter 5*a* is exposed. Moreover, the dummy emitter 5*b* having an acute shape is formed on the dummy electrode 3*b*.

Figure 11:
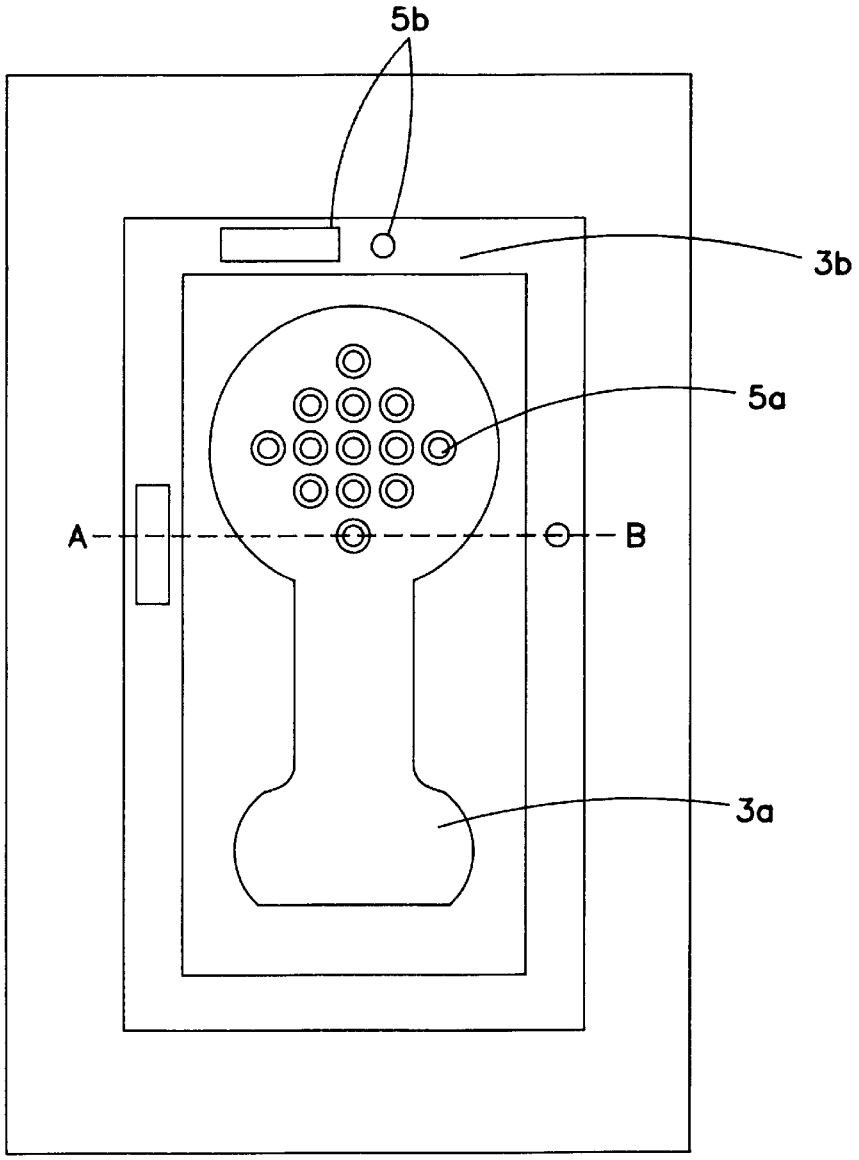
FIG. 11 is a plan view of the fourth embodiment of the field emission cold cathode of the present invention.

A plan view of the field emission cold cathode of the fourth embodiment of the present invention is shown in FIG. 11. FIG. 10 is a sectional view taken along the line A–B in FIG. 11. As shown in the drawings, the dummy electrode 3*b* is disposed around the gate electrode 3*a*, and protrusions higher than the gate electrode 3*a* are formed on the parts of the dummy electrode 3*b*, in case of this embodiment, acute dome-shaped and cone-shaped emitters 5*b* are formed. Thus, the discharge from the dummy emitter 5*b* having the protrusion structure which is acute in the height direction dominates and the discharge of the gate electrode is more suppressed than in the example of the plan structure described above. In this embodiment, though the dummy emitter 5*b* is formed utilizing the emitter formation step, a method in which the dummy emitter 5*b* is selectively formed on the dummy electrode 3*b* using a laser CVD technique may be utilized. Moreover, the gate electrode 3*a* is formed such that it has the sectional shape in which the corner portions are an obtuse angle as in the first embodiment, whereby the discharge of the gate electrode can be more suppressed.

Figure 12A:
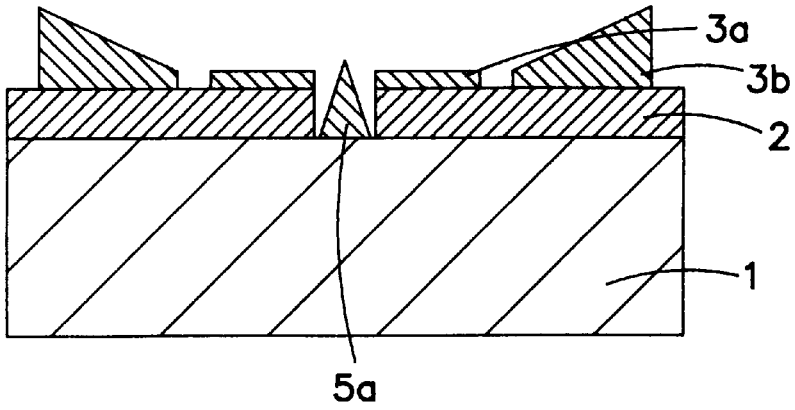
FIG. 12(*a*) and FIG. 12(*b*) are sectional views of a fifth embodiment of a field emission cold cathode of the present invention.
Figure 12B:
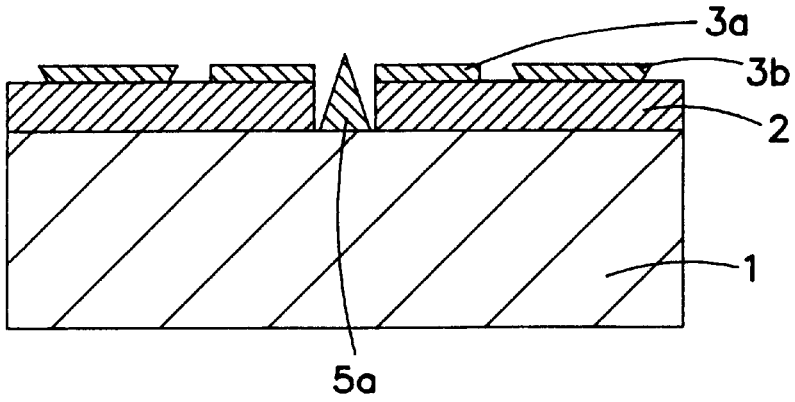

Next, manufacturing steps of a fifth embodiment will be described using sectional drawings shown in FIGS. 12(*a*) and 12(*b*).

This field emission cold cathode has a structure in which an insulating film 2 of about 500 nm thick such as an oxide film is formed on a surface of an n-type silicon substrate 1 of a concentration of about $10^{15}/cm^3$ by a thermal oxidation, an emitter 5*a* formed of a metal such as Mo is formed on the silicon substrate 1, a gate electrode 3*a* of about 200 nm thick surrounding the emitter 5*a* and a trapezoidal dummy electrode 3*b* having acute ridge line portions are formed, the dummy electrode 3*b* being disposed around the gate electrode 3*a* and partially thicker than the gate electrode 3*a*. The trapezoidal dummy electrode 3*b* can be formed by selectively stacking a dummy electrode material at the thicker portion while varying a width. Also in this method, since the dummy electrode has a shape which is acute in the height direction, the same effect can be obtained as that of the fourth embodiment, the discharge of the dummy electrode occurs more than in the gate electrode, resulting in suppression of the discharge of the gate electrode. Moreover, by setting the section shape of the gate electrode 3*a* to be obtuse, the discharging suppression effect can be increased.

In the above descriptions, the emitter is formed of a metal film such as Mo. However, in the present invention the emitter material is not limited to metal materials, a emitter formed by working silicon to be an acute shape may be applied to a field emission cold cathode. Moreover, an emitter formed by coating a thin metal film on silicon may be also applied to a field emission cold cathode.

Moreover, an application field of the present invention is a display device utilizing a field emission cold cathode as an electron gun. Since this display device is usually required to operate in vacuum, it has been difficult to exchange the electron gun after incorporating it into the display device. Particularly, in case of a flat panel display, a device is short-circuited due to a discharge breakdown so that the device is broken. When the quantity of the discharge current as an electron gun changes at the place of breakdown, a difference in luminance between periphery portions is produced or a dark point remains, whereby an operational malfunction of the device is brought about. When such a situation occurs, when the field emission cold cathode of the present invention is applied to a flat panel display as an electron gun, a plurality of electron guns operate without breakdown. Therefore, a display operation of the display device can be continued for a long time so that the life time of the device can be prolonged. It should be noted that the field emission cold cathode of the present invention can be applied to a cathode tube (CRT) for displaying as well as a flat panel, as a display device.

It should be understood that variations and modifications of a field emission cold cathode of the present invention disclosed herein will be evident to those skilled in the art. It is intended that all such modifications and variations be included within the scope of the appended claims.

What is claimed is:

1. A field emission cold cathode comprising:

a cone-shaped emitter having an acute tip formed in an opening;

a gate electrode having an opening surrounding and spaced from said emitter, formed on an insulating film, said gate electrode having an edge portion spaced from and facing the emitter tip, said gate electrode being formed to have no acute angle of less than 90 degrees in both plane and sectional view;

an anode electrode for receiving electrons emitted from the tip of said emitter by an electric field concentrated by said gate electrode, spaced from said emitter; and a dummy electrode having a side with an edge portion thereof spaced from and surrounding said gate electrode, said dummy electrode side edge portion being formed with an interior angle less than that of said gate electrode edge portion.

2. The field emission cold cathode according to claim 1, wherein the edge portion of said gate electrode, when viewed from above, is arc-shaped.

3. The field emission cold cathode according to claim 2, wherein the edge portion of said gate electrode, when viewed in section, is arc-shaped.

4. The field emission cold cathode according to claim 1, wherein the edge portion of said gate electrode, when viewed from above, is obtuse-shaped.

5. The field emission cold cathode according to claim 4, wherein the edge portion of said gate electrode, when viewed in section, is arc-shaped.

6. The field emission cold cathode according to claim 1, wherein said dummy electrode, when viewed in section, in horizontal and vertical directions, is formed with at least one interior angle smaller than that of said gate electrode.

7. A display device wherein the field emission cold cathode recited in claim 1 is used as an electron gun.

8. The display device wherein the field emission cold cathode recited in claim 1 is used in a flat panel display.

9. The display device wherein the field emission cold cathode recited in claim 1 is used in a cathode display tube.

10. A field emission cold cathode comprising:

a cone-shaped emitter having an acute tip formed in an opening;

a gate electrode, formed on an insulating film, having an opening surrounding and spaced from said cone-shaped emitter; and a dummy electrode surrounding and spaced around said gate electrode, formed on said insulating film, said dummy electrode having an edge portion being formed with an interior angle smaller than that of said gate electrode; and an anode electrode for receiving electrons emitted from the tip of said cone-shaped emitter by an electric field concentrated by said gate electrode, spaced from said cone-shaped emitter.

* * * * *